US005143215A

United States Patent [19]

Hartley et al.

[11] Patent Number: 5,143,215

[45] Date of Patent: * Sep. 1, 1992

[54] BATTERY DISPLAY PACKAGE

[75] Inventors: William L. Hartley, Annapolis, Md.; John E. Allen, Avon Lake, Ohio

[73] Assignees: P.T.P. Industries, Baltimore, Md.; Eveready Battery Company, Inc., St. Louis, Mo.

[ * ] Notice: The portion of the term of this patent subsequent to May 4, 2007 has been disclaimed.

[21] Appl. No.: 685,181

[22] Filed: Apr. 17, 1991

Related U.S. Application Data

[63] Continuation-in-part of Ser. No. 544,402, Jun. 27, 1990, Pat. No. 5,018,622.

[51] Int. Cl.[5] ..... B65D 85/62

[52] U.S. Cl. ..... 206/333; 206/461; 206/467; 206/459.5

[58] Field of Search ..... 206/45.23, 45.31, 45.34, 206/461, 463, 467, 470, 471, 459, 333, 806; 220/4.21; D9/415

[56] References Cited

U.S. PATENT DOCUMENTS

| | | | |
|---|---|---|---|
| D. 185,890 | 8/1959 | Barton | 206/471 |
| D. 267,394 | 12/1982 | Liptak et al. | D9/415 |
| D. 294,123 | 2/1988 | Hill | D9/415 |
| D. 305,733 | 1/1990 | Ferris | D9/415 |
| 2,937,746 | 5/1960 | Ferguson | 206/463 |
| 3,424,306 | 1/1969 | Munck | 206/333 |
| 3,776,375 | 12/1973 | Rohdin | 206/463 |
| 3,856,137 | 12/1974 | Brindley | 206/462 |
| 3,881,601 | 5/1975 | Walus et al. | 206/471 |
| 3,937,389 | 2/1976 | Wind | 220/4 B |
| 4,427,705 | 1/1984 | Wyslotsky et al. | 206/461 |
| 4,512,474 | 4/1985 | Harding | 206/470 |
| 4,687,129 | 8/1987 | Cugley | 206/470 |
| 4,896,770 | 1/1990 | Calcerano et al. | 206/461 |
| 4,899,882 | 2/1990 | Benner | 206/459 |
| 4,930,627 | 6/1990 | Borst et al. | 206/45.23 |
| 4,958,731 | 9/1990 | Calcerano | 206/333 |
| 5,018,622 | 5/1991 | Hartley | 206/470 |
| 5,020,669 | 6/1991 | Nakagoshi | 206/459 |
| 5,029,705 | 7/1991 | Schmidt et al. | 206/333 |
| 5,038,936 | 8/1991 | Borst | 206/45.23 |

FOREIGN PATENT DOCUMENTS

| | | | |
|---|---|---|---|
| 2557540 | 6/1877 | Fed. Rep. of Germany | 206/461 |
| 2578515 | 9/1986 | France | 206/333 |

*Primary Examiner*—David T. Fidei
*Attorney, Agent, or Firm*—Leonard Bloom

[57] ABSTRACT

A blister package for the display of four batteries. The package includes a housing formed by a front blister, a rear blister and a diagonal seam formed therebetween for removably joining the blisters to one another. Two lower batteries are substantially horizontally disposed in the housing in a side-by-side arrangement. Two upper batteries are also substantially horizontally disposed in the housing in a side-by-side arrangement on top of the lower batteries. A header is joined to the seam, so as to extend upwardly therefrom. A pocket formed in the top portion of the front blister receives and displays advertising material that is disposed therein and which extends into the header. A pocket formed in side walls of the blisters receives the positive terminals of the batteries.

19 Claims, 12 Drawing Sheets

BATTERY DISPLAY PACKAGE

CROSS-REFERENCE TO RELATED APPLICATION

The present application is a continuation-in-part of U.S. patent application, Ser. No. 544,402 entitled "BATTERY DISPLAY PACKAGE", filed Jun. 27, 1990 now U.S. Pat. No. 5,018,622, the contents of which are hereby incorporated herein.

FIELD OF THE INVENTION

The present invention relates to packages for the shipment and display of items and, in particular, to blister packages for the display and shipment of batteries.

BACKGROUND OF THE INVENTION

For the most part, common battery packages were originally designed for two batteries at a time. However, portable electronic devices that require the use of more than two batteries have become increasingly popular. Thus, it has become necessary to provide packages that hold at least four batteries therein.

Unfortunately, packages that hold four (or more) batteries therein face particular problems.

First, the size of such packages has often proven difficult. Most existing display racks (for hanging) and shelves are sized for the lateral width of conventional two-battery packages and do not possess a lateral width that is large enough for four cells to be vertically disposed side-by-side in a "four-across" arrangement. This is due to the fact that the lateral width of the conventional two-cell package is about four inches, less than the combined lateral width of four "C" or "D" cells that are vertically positioned in a side-by-side arrangement. To use larger packages would require replacement or enlargement of present display racks and shelves.

Second, it is preferred that the cells be displayed in clear packaging, so that the batteries are visible to potential purchasers. In this regard, it is further desired that potential purchasers be able to view more than just two of the cells in the package. In this manner, potential purchasers will not incorrectly believe that the marked price for the four cells is the price for only two cells.

Third, when hanging (rack) space is not available, the battery packages must be free-standing and self-supporting for being placed on a shelf. In order to increase the amount of packages displayed, it is often desired to stack the packages. The necessity to be stackable is even more acute when the package is large, such as when four-battery packages are involved. Lack of such stackability may even prevent such packages from being stocked and/or displayed.

Fourth, it is essential that such large packages be complementary shaped to permit multiple alignment, so that one package is immediately adjacent to the next package without wasting space. Thus, the amount of space needed therefor is reduced as much as possible for aiding in the storage and shipment thereof.

There have been several packages of which I am aware that attempt to address the above-mentioned problems.

In U.S. Pat. No. 4,896,770 issued to Calcerano et al, a battery package is disclosed that attempts to solve the problems associated with lateral width and the ability to view at least three of the cells packaged therein. The batteries are vertically oriented with three of the batteries in a staggered side-by-side arrangement, wherein one of the three batteries is positioned between and partially forwardly of the other two cells. The fourth cell is positioned between and partially behind the other two cells mentioned above, being directly behind the one of the three batteries.

While presenting a reduced lateral width than the "four-across" arrangement simultaneously with permitting three of the batteries to be viewed, such a package nonetheless still possesses a lateral width that is undesirably large.

Also, the package disclosed in Calcerano et al, is provided with blisters that have surfaces which are specifically contoured to conform to the shape and size of the particular cells to be held therein.

Further, it is noted that packages having such irregular shapes are not complementary shaped and do not permit the multiple alignment thereof that would permit one package to be immediately adjacent to one another. Rather, space is wasted therebetween. This increases the amount of space needed for the shipment, storage and display of such packages.

Finally, it is noted that the package is also equipped with a header (to permit the hanging thereof on, i.e., a display rack) that prevents the satisfactory stacking thereof during shipment, storage and display. Thus, further problems with space availability are presented.

I am also aware of another package presently being marketed that is substantially the same as that of Calcerano et al, but which does not present or possess contoured edges. That package, in having the batteries disposed in the same vertical staggered arrangement as Calcerano et al, likewise possess a lateral width that is undesirably large. Also, this package is also equipped with a header that limits the stacking thereof during shipment, storage and display, thus presenting further problems with space availability.

Another package of which I am aware involves a strip package wherein four batteries are horizontally oriented in a "four-down" arrangement in which each battery is spaced from the next and further in which a blank sheet of space is formed between the second and third batteries. Further, various "bubbles" are formed along the vertical height of the strip to aid in permitting the strip package to be folded into a quadrilateral shape for use as a free-standing display. Unfortunately, the vertical height of this strip package is, when unfolded, over twice as great as conventional packages and even when folded, is still vertically taller than the conventional packages. This presents problems of storing and displaying such packages on display racks where available vertical height is often limited.

In German Patent No. 2557540 issued to Schneider, a transport container for full sacks is disclosed. Like the conventional packages for holding four batteries that were discussed above, this container holds the sacks so that the sacks are vertically disposed in the "four-across" arrangement. Thus, if used for holding batteries, such a package would present a lateral width that is larger than the width of conventional two-cell packages. Also, this container is specially contoured, thus presenting problems with the stackability and multiple alignment thereof, as described above.

Thus, it can be seen that there remains a need for a package for the display of at least four batteries wherein the lateral width of the batteries disposed therein is the same as that of the conventional two battery packages and which package may be easily stacked for the shipment, storage and/or display thereof.

SUMMARY OF THE INVENTION

It is the primary object of the present invention to provide a package for the display of four batteries that provides for a savings of space, that enhances product visibility by maintaining the visual integrity of the product and logo, that has space available for disposing publicity or special offers while maintaining the visual integrity of the product and logo, which enhances merchandise presentation and which provides significant savings by reducing production, packaging and transportation costs.

A primary object of the present invention is to provide a package for the display of batteries wherein four batteries are disposed in an arrangement wherein the lateral width of the batteries is the same as that of conventional two battery packages, thereby providing a savings of space.

Another primary object of the present invention is to provide such a four-battery display package that holds the batteries in place and which provides a header for securing publicity and logos therein, thereby enhancing product visibility by maintaining the visual integrity of the product and the logo.

Yet another primary object of the present invention is to provide such a four-battery display package that provides increased availability of space for disposing publicity or special offers while maintaining the visual integrity of the product and the logo.

A yet further primary object of the present invention is to provide such a four-battery display package that enhances merchandise presentation by a header for the display thereof on either a conventional or a special display rack, while substantially eliminating alignment problems which header nonetheless does not prevent the stacking of such packages for the shipment, storage and/or display thereof.

A still further primary object of the present invention is to provide such a package to be complementary-shaped to permit multiple alignment, so that one package is immediately adjacent to the next package, so that the packages may be easily and satisfactorily positioned and displayed on a shelf while minimizing lost or wasted space and maximizing the use of the space available.

A yet still further primary object of the present invention is to provide such a four-battery display package that provides materials savings by eliminating the need for the plastic display tray and reduces the amount of corrugated board.

In accordance with the teachings of the present invention, a package is disclosed for the display of batteries. This package includes a housing formed by a front blister and a rear blister. The housing has a substantially diagonal seam formed therebetween for joining the first and second blisters to one another. The housing is sized to receive therein at least two lower batteries that are disposed substantially horizontally therein in a side-by-side arrangement and at least two upper batteries. The upper batteries are disposed substantially horizontally in the housing on top of the lower batteries. A header is formed with the housing and extends upwardly therefrom. In this fashion, the package may be hung, being supported by the header, and the packages may be stacked vertically by inverting one package over the other so that the headers are oriented along the respective fronts of the vertically disposed packages.

Preferably, the front blister has a top portion. The top portion is substantially adjacent to the header when the front and rear blisters are joined to one another. The top portion of the front blister has an enlarged pocket formed therein to receive and display at least a portion of advertising material that is disposed in the package on top of the batteries. The advertising material is further disposed so as to extend from this enlarged pocket and into the header portion when the front and rear blisters are joined to one another.

It is further preferred that the front and rear blisters have respective opposite side walls and that one of the side walls of each of the blisters have respective mating pockets formed therein. In this manner, when the blisters are joined to one another, a single enlarged pocket is formed. This pocket receives the respective positive terminals of each battery. This also provides that proper orientation of all the batteries disposed in the package is assured. This also permits the batteries to be fitted into a minimal space while being easily read and viewed when in the package.

These and other objects of the present invention will become apparent from the following specification, when taken in conjunction with the enclosed figures.

DESCRIPTION OF PREFERRED EMBODIMENTS

Figure 1:
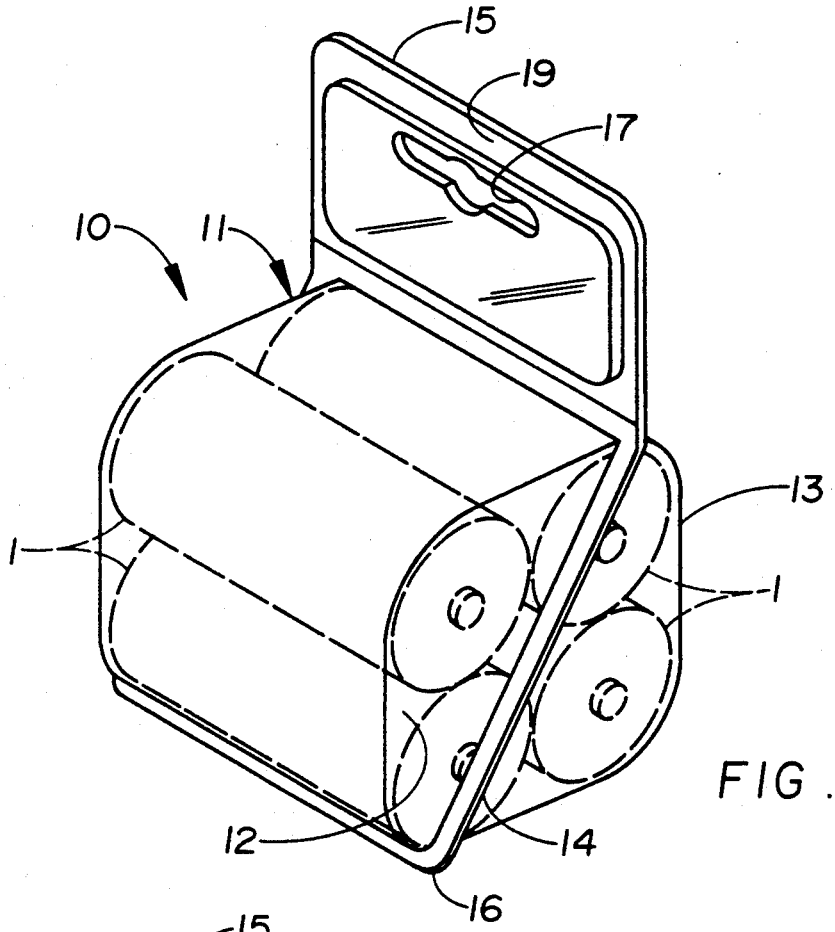
FIG. 1 is a front perspective view of the package of the present invention.
Figure 2:
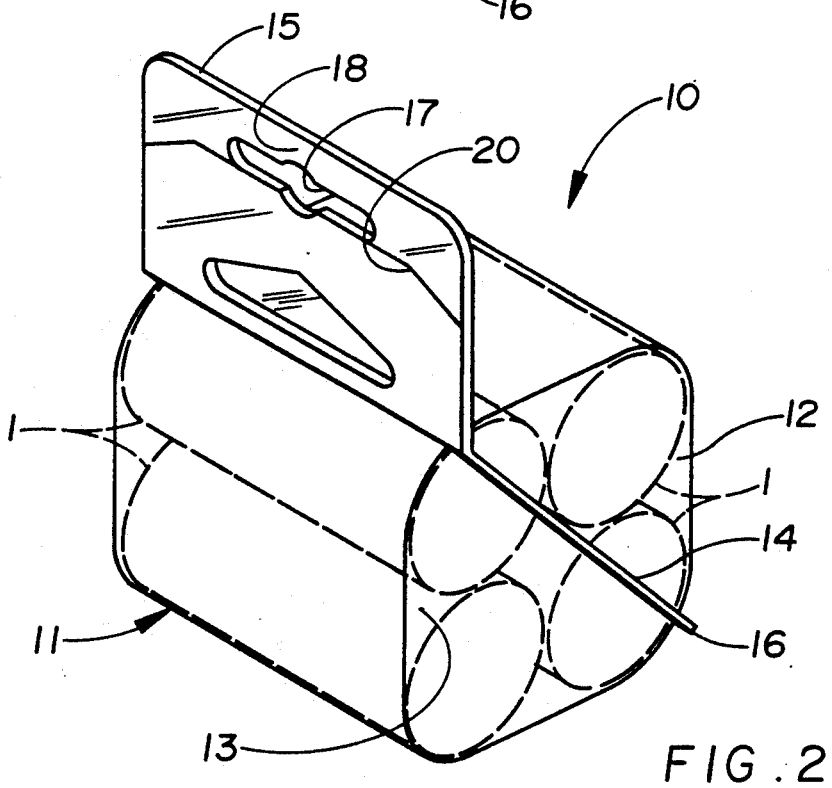
FIG. 2 is a rear perspective view of the package of the present invention.
Figure 3:
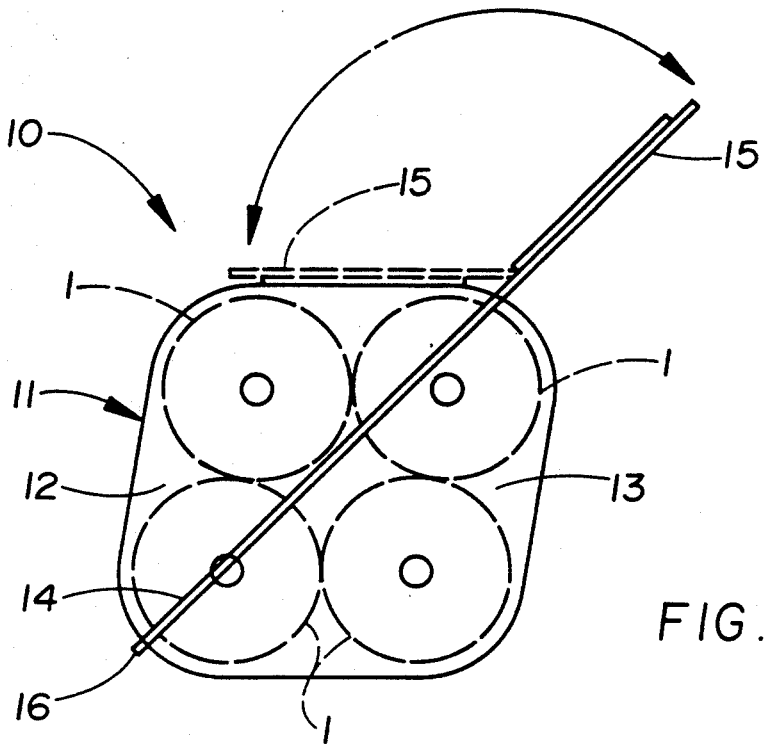
FIG. 3 is a side view of the package showing, in phantom lines, the alternative positioning of the header and the pivoting of the header when provided with a living hinge.

Referring now to the drawings, and in particular, to FIGS. 1-3, the package 10 is a blister package for displaying four batteries 1 therein. The package 10 includes a housing 11 formed by a front (first) blister 12 and a rear (second) blister 13. The front and rear blisters 12 and 13, respectively are removably joined to one another along a substantially diagonal seam 14. Also formed with the housing 11 is a header 15 that extends substantially upwardly therefrom.

The two components 12 and 13 of the package 10 are fabricated from a transparent, heavy gauge, thermoplastic material. An example of such is cold, crack resistant polyvinyl chloride. Preferably, the thermoplastic sheets are about 0.014 inches thick. Also, recycled PVC and recycled board (for the header advertising material) may be utilized, thereby benefitting the environment.

The housing 11 of the package 10 is sized to receive therein a pair (at least two) of lower batteries that are disposed substantially horizontally therein in a side-by-side arrangement. In this respect, one of the two lower batteries (the lower forward battery) is positioned forwardly in front of the other of the two lower batteries (the lower rearward battery). The housing 11 is further sized to receive therein a pair (at least two) of upper batteries that are also disposed substantially horizontally therein in a side-by-side arrangement on top of the lower batteries. In this respect, one of the two upper batteries (the upper rearward battery) is positioned rearwardly behind the other of the two upper batteries (the upper forward battery).

Each of the batteries 1 mentioned above has a midpoint that is coincident with the terminal of the respective battery. It is noted that the lateral width of the package 10 when the batteries are horizontally disposed or oriented is less than the lateral width of a package when three batteries are vertically disposed or oriented. Generally the overall lateral width of the package 10 is reduced so that four packages fit in the space that three packages of the prior art would occupy. In this respect, it is obvious that with the package 10 of the present invention, one can get more product in the same amount of display space. For every three conventional packages that will fit into a display space, four packages of the present invention will be accommodated. This results in an increase in the product-to-space of approximately thirty-three percent.

Preferably, the seam 14 is not centered but is offset towards the front blister 12, such that the rear blister 13 is larger than the front blister 12. In this respect, it is especially preferred that the diagonal seam 14 extends from the upper rear of the package 10 to the lower front and intersects the one of the two upper batteries (the upper rearward battery) forwardly of the midpoint thereof, and further that the diagonal seam 14 intersects the one of the two lower batteries (the lower forward battery) at the midpoint thereof. Furthermore, this offset seam 14 provides a rear blister 13 that can hold all of the batteries 1 therein, so that during manufacture the batteries 1 are stacked in the rear blister 13 while it is horizontal. The front blister 12 may then be placed over the rear blister 13 and the batteries 1 therein and be welded (by, for example, radio frequency welding, ultrasonic welding or heat sealing) thereto along the said seam 14.

Figure 4:
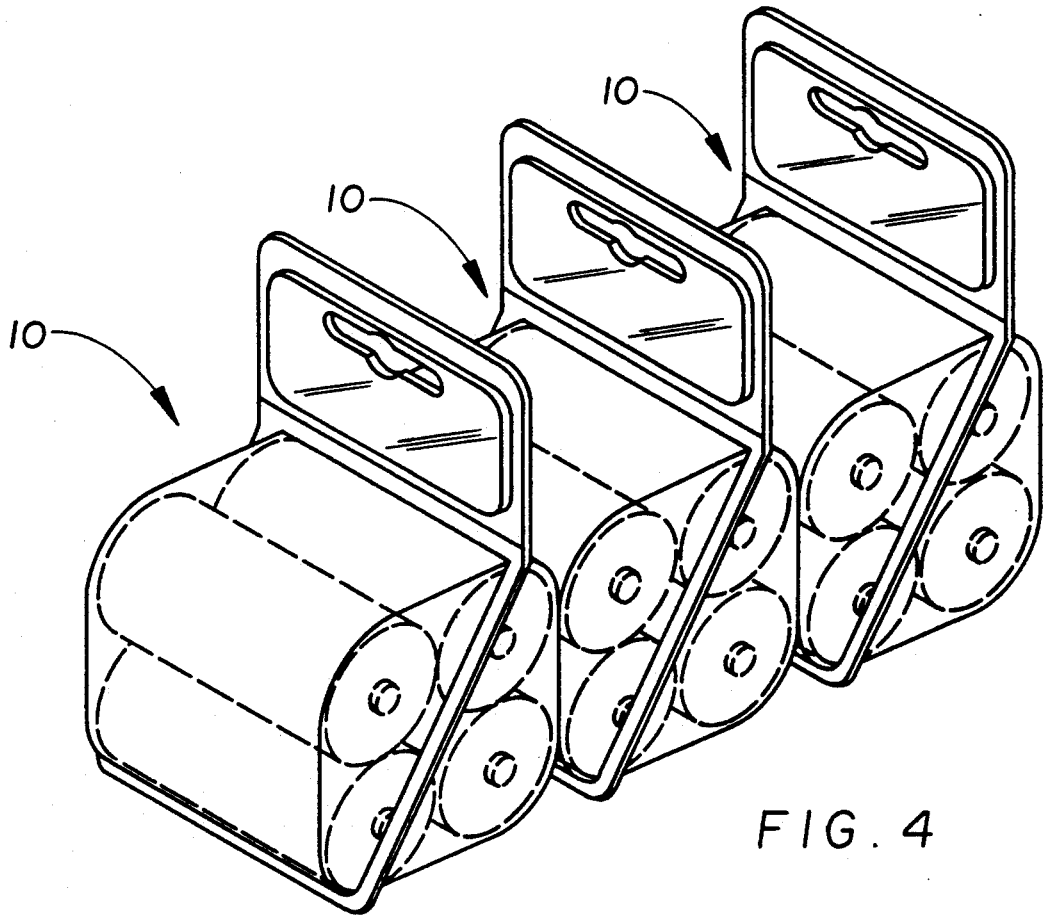
FIG. 4 illustrates the disposal of the packages on a shelf for the display thereof in multiple alignment, so that one package is immediately adjacent to the next package without wasting any space therebetween.
Figure 5:
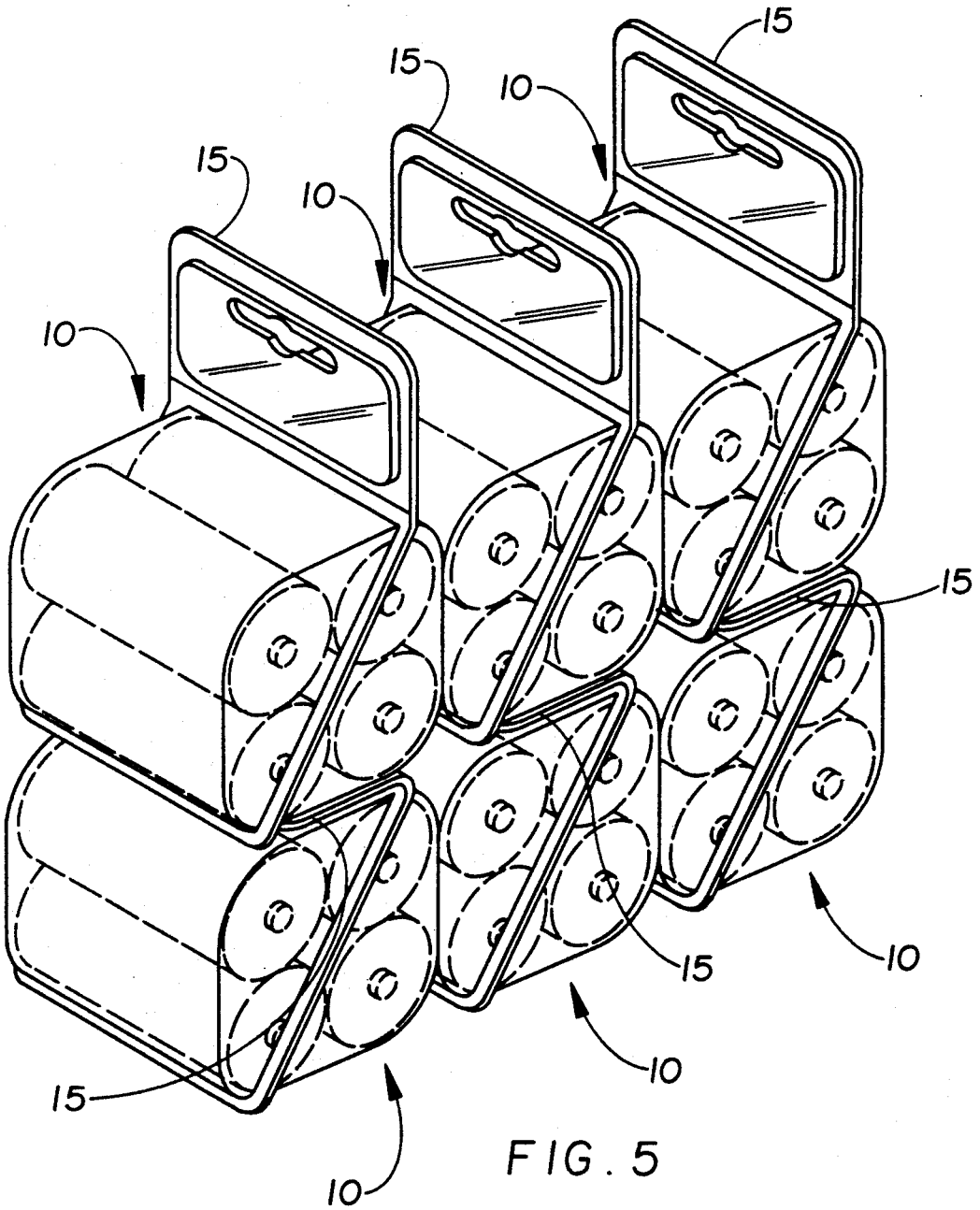
FIG. 5 corresponds substantially to FIG. 4 and further shows how the packages are stacked on one another during the storage or display thereof.

It is noted that, preferably, the housing 11 is substantially quadrilateral (rhomboid, rectangular or square) in shape having an upper rear and upper front as well as a lower rear and a lower front. In this fashion, the housings 11 are complementary-shaped permitting the multiple alignment thereof with other such packages. This permits each of the packages 10 to be positioned immediately adjacent to the next package without wasting space therebetween (see, in particular, FIGS. 4-5 and 8).

Figure 8:
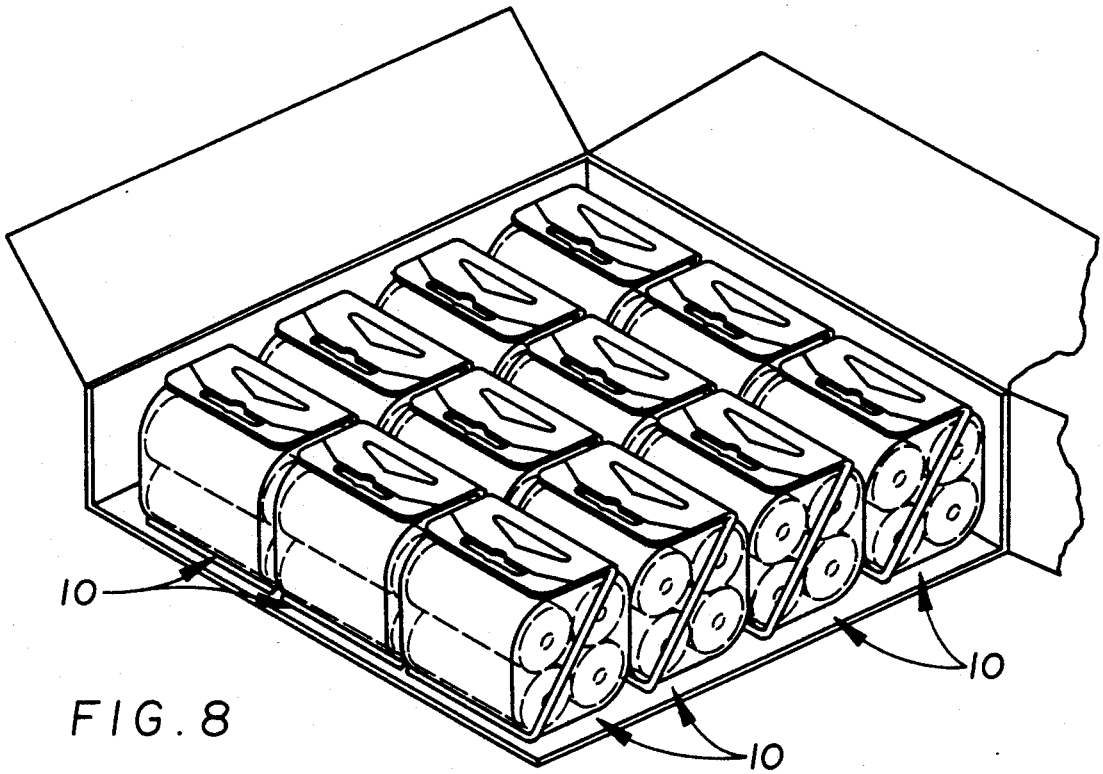
FIG. 8 shows how the packages are disposed in a carton with the headers bent over the respective housings of the various packages for the shipment thereof.
Figure 9:
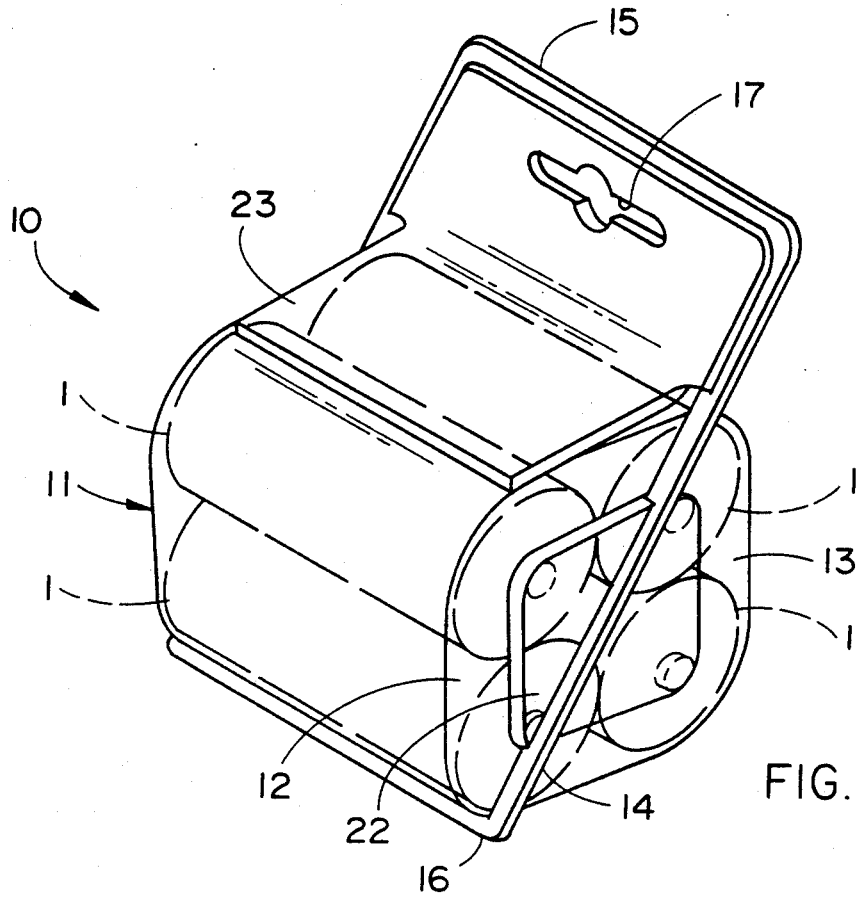
FIG. 9 is a front perspective view of another embodiment of the package of the present invention.
Figure 10:
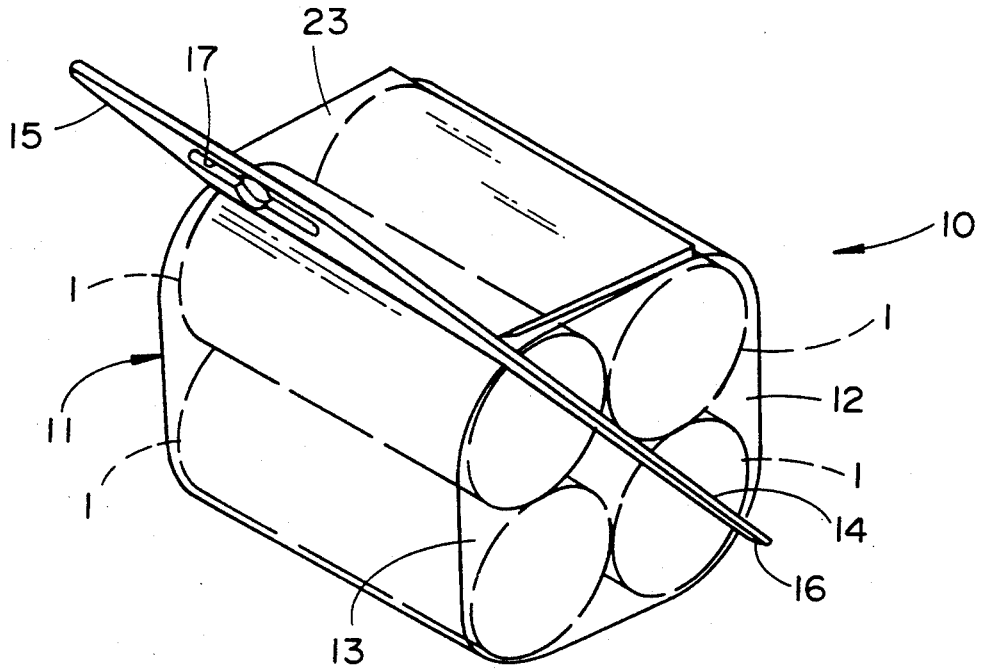
FIG. 10 is a rear perspective view of the package of FIG. 9.

The seam 14 is formed so as to include an edge 16 that extends substantially downwardly from the blisters 12 and 13. In this fashion, a foot 16 is defined thereby. This foot 16 aids in supporting the package 10 level on a flat surface such as a shelf or counter (FIGS. 4-5) or in a box (FIG. 8).

Figure 6A:
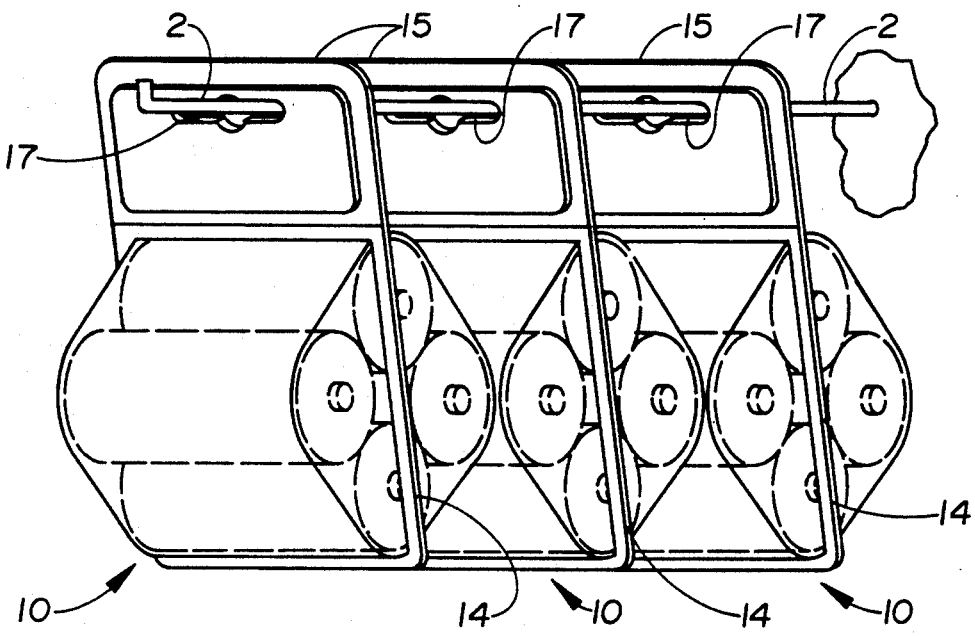
FIG. 6A–6B illustrate the disposal of the packages on a rack for the display thereof by being hung by the header.
Figure 6B:
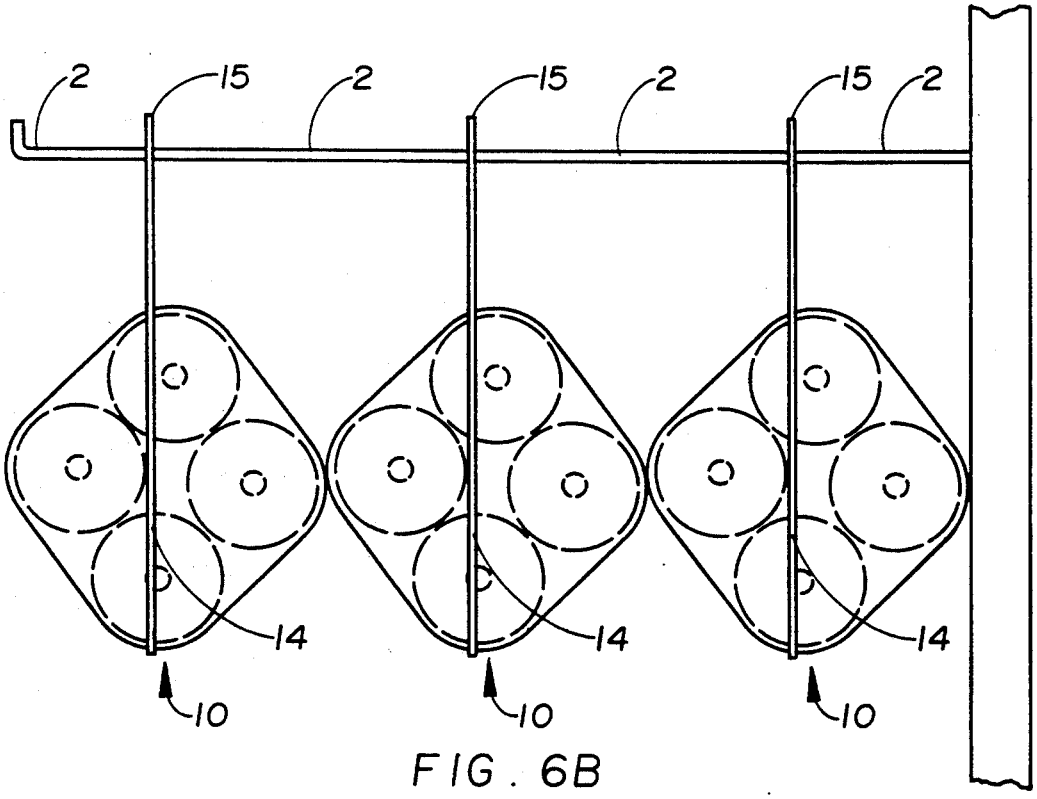

Preferably, the header 15 is formed with the housing 11 on the top of the housing 11 being offset rearwardly on the housing 11. In this fashion, when supported by the header 15, the front blister 12 of the housing 11 hangs downwardly, thereby displaying at least three of the batteries 1 when the package is viewed from the front (FIGS. 6A-6B).

It is further desired that the header 15 be joined to the blisters 12 and 13 by a living hinge. This hinge permits the header 15 to be resiliently pivoted relative to the seam 14 (or the housing 11) for being folded (forwardly) over the package 10 during the stacking and shipping thereof (see FIGS. 3, 5 and 8). In this regard, it is noted that, when the header 15 is folded over the package, the package occupies very little space. This permits the package 10 of the present invention to be placed in a box 3 of four rows three in a row, to reduce shipping and storage space. This further permits the packages 10 to be shipped without having a shipping tray.

The header 15 has an aperture rack stand hole or cut out 17 formed therein for removably receiving a support 2, such as a display rack, therethrough. In this fashion, the package 10 may be hung from the support 2 for the display thereof (see. FIG. 6).

Figure 7:
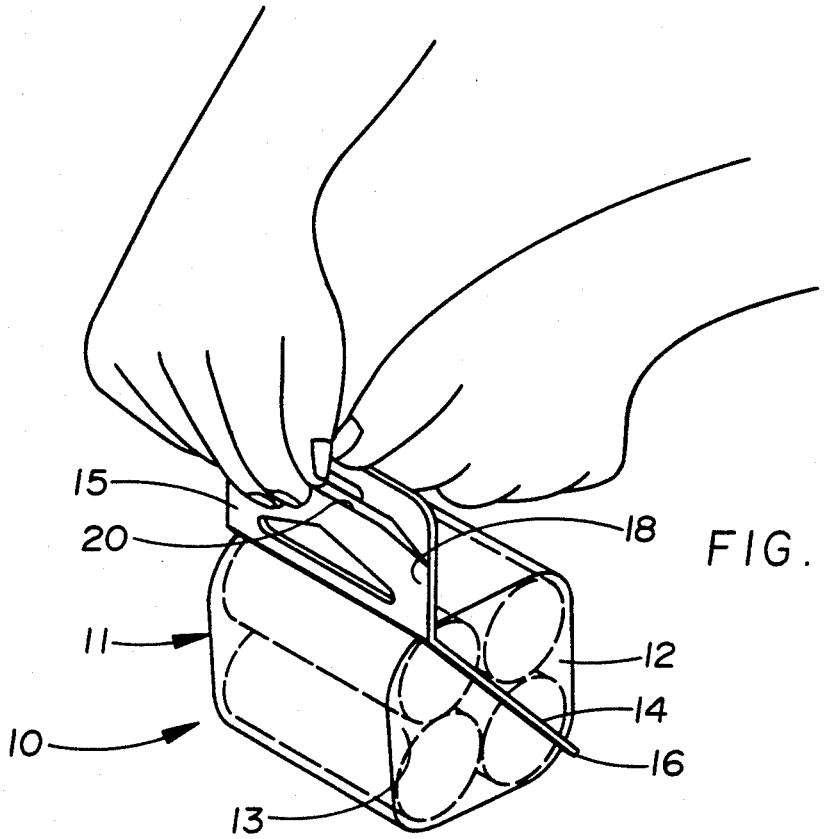
FIG. 7 is a rear view of the package showing the two-layer construction of the header and how the user thereof separates the two layers of the header for opening the package.

With particular reference now to FIGS. 1, 2 and 7, the header 15 is formed from a back layer 18 and a front layer 19. The back layer 18 is formed in the rear blister 13 and the front layer 19 is formed in the front blister 12. The two (front and back) layers 18 and 19 are joined to one another by appropriate means (such as radio frequency welding etc.).

A slit 20 is formed (die cut) in the back layer 18. Preferably, this slit 20 is located at the base of hole 17. This permits the user to insert a finger into the slit 20 and grasp one of the layers (the back layer 18) of the package. The back layer 19 can then be peeled downwardly for gaining access to the batteries 1 carried therein.

If desired, a sheet with printing thereon may be inserted between the two layers 18 and 19 of the header 15. Alternatively, printing may be directly made on either or both of the layers 18 or 19. In this respect, it is also noted that the clear nature of the housing permits insignia, information, etc., that is printed on the batteries themselves to be viewed by potential purchasers.

Referring now to FIGS. 9–14, 16 and 17, the second embodiment of the package 10 is illustrated. Like the package 10 described above the reference to FIGS. 1–8, the package 10 illustrated in FIGS. 9–14, 16 and 17 includes a housing 11 that is formed by a front (first) blister 12 and a rear (second) blister 13, that are joined to one another along a substantially diagonal seam 14, in the same manner (i.e., welding) as described above. In this embodiment, the header 15 is integrally joined to a portion of the diagonal seam 14 of the housing 11, so as to extend substantially upwardly therefrom.

The housing 11 of the package 10 of FIGS. 9–14, 16 and 17 is also sized to receive therein a pair (at least two) lower batteries and a pair (at least two) upper batteries in the same stacked, side-by-side arrangement, as described above relative to FIGS. 1–8.

As seen herein, the housing 11 of this second embodiment is substantially square in shape, having an upper rear, upper front, lower rear and lower front. The diagonal seam 14 is substantially centered, so that the blisters 12 and 13 are substantially the same size. In this respect, the diagonal seam 14 extends from the upper rear to the lower front of the package 10, intersecting the midpoint of one of the lower batteries (the lower forward battery). Thus, the blisters 12 and 13 of the housing 11 are complementary-shaped, permitting the multiple alignment thereof with other such packages 10. This permits each of the packages 10 to be positioned immediately adjacent to the next package 10 without wasting space therebetween (see, in particular, FIG. 13).

The seam 14 is formed, so as to include an edge 16 that extends substantially downwardly from the blisters 12 and 13. In this fashion, a foot 16 is defined thereby. Once again, this foot 16 aids in supporting the package 10, so that it is level on a flat surface, such as a counter, shelf or box (see FIG. 11).

Figure 12:
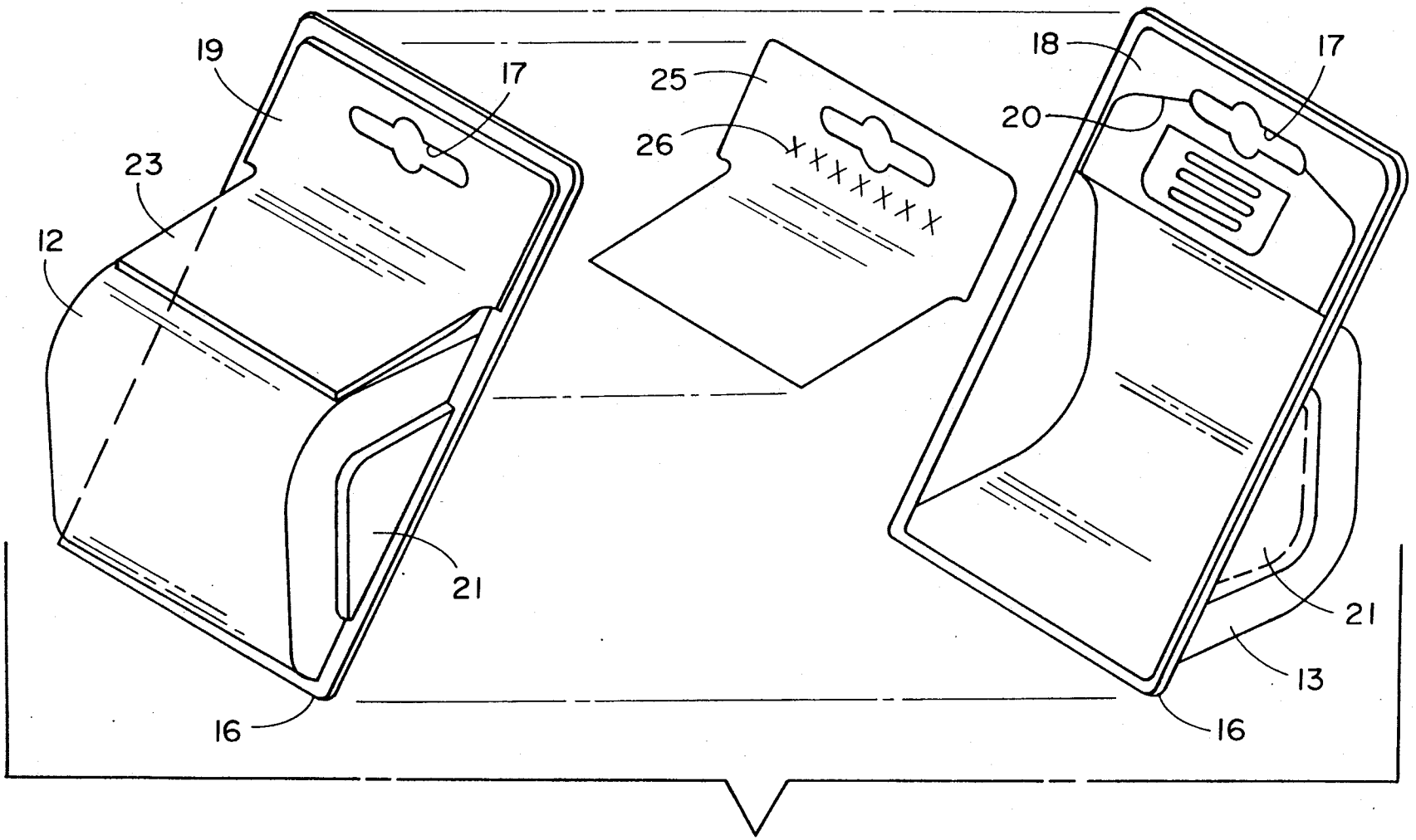
FIG. 12 is a perspective view of the package of FIG. 9, wherein the package is open with the batteries removed therefrom for the sake of clarity.
Figure 14:
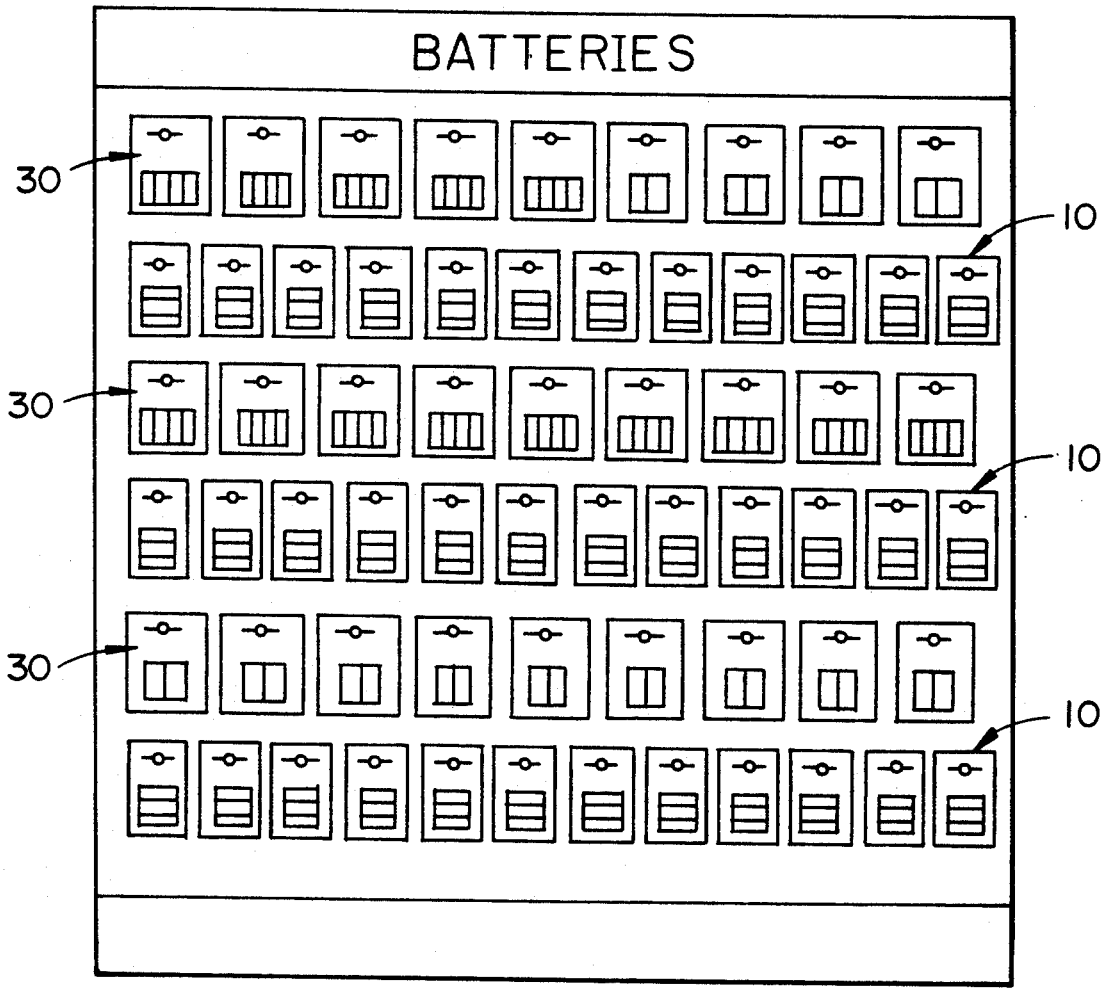
FIG. 14 illustrates the disposal of the package of FIG. 9, together with the prior art, hung on a rack for the display thereof.
Figure 11:
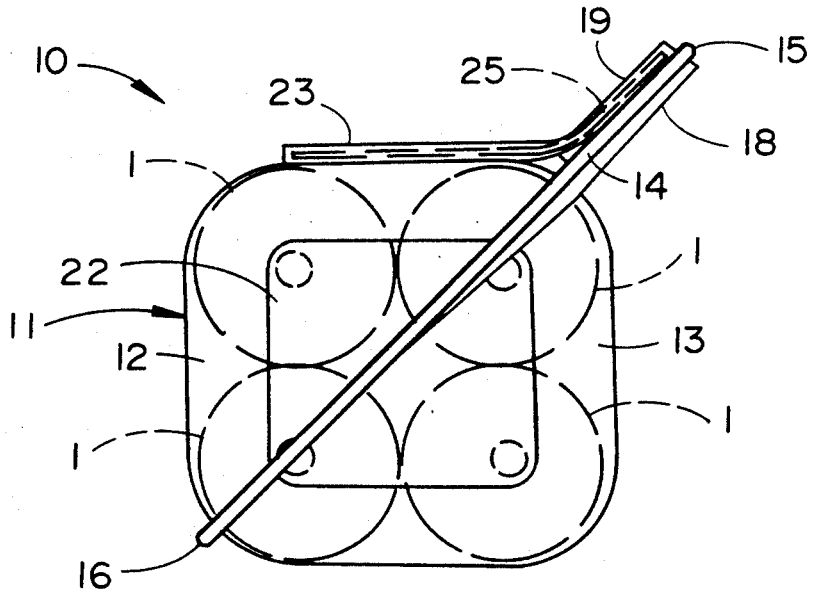
FIG. 11 is a side view of the package of FIG. 9.
Figure 13:
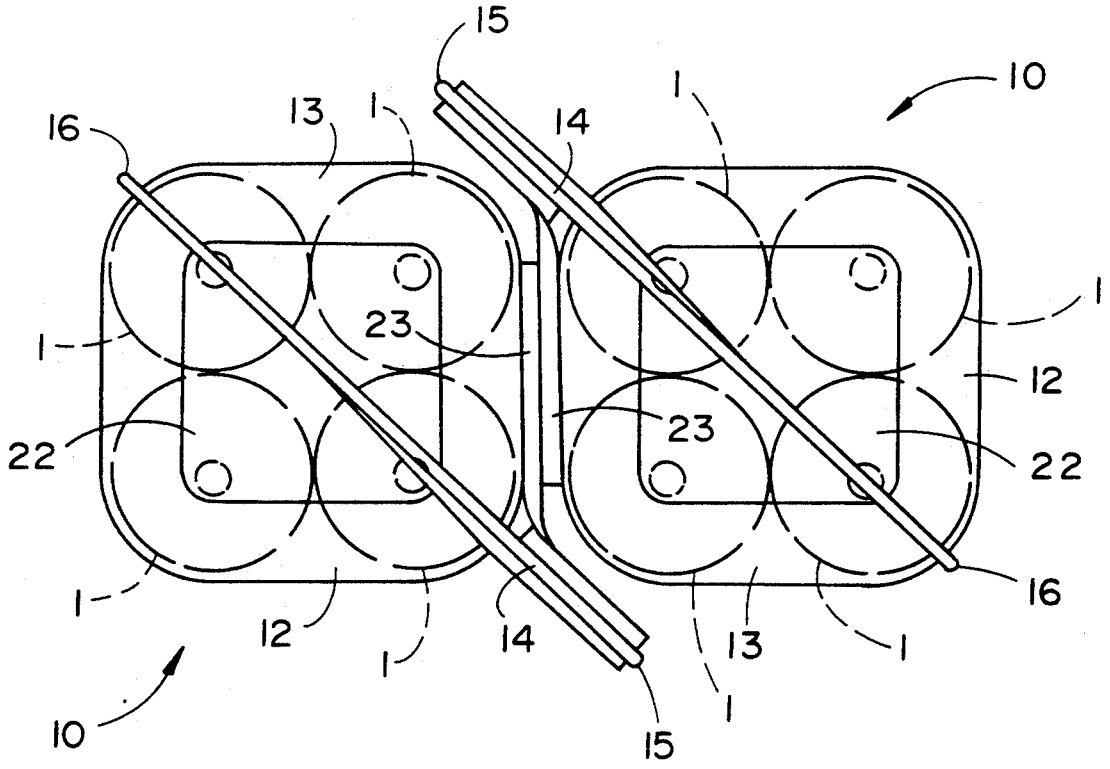
FIG. 13 shows how the packages of FIG. 9 are disposed in a carton being vertically stacked by inverting one package over the other, so that the headers are oriented along the respective fronts of the vertically adjacent packages.

Preferably, the blisters 12 and 13 have respective opposite side walls. The same one of the side walls of each blister 12 and 13 has a respective mating pocket half 21 formed therein. When the blisters 12 and 13 are joined to one another, the mating pocket halves 21 form a single enlarged pocket 22 that is located approximately half in the front blister 12 and approximately half in the rear blister 13 (FIG. 12). This single enlarged pocket 22 receives therein the positive terminals of each battery. In this fashion, the proper orientation of all the batteries disposed in the package 10 is assured, so that the batteries may be easily viewed and read when in the package 10.

It is noted here that the provision of the pocket 22 described above also permits the batteries to be fitted in a minimal space. In this respect, the blisters 12 and 13 are sized, such that the horizontal length of the blisters with the pockets 21 is slightly larger than the vertical length of the batteries with the terminals. Thus, the package 10 is provided having a minimal width.

The header 15 is an integral extension of the diagonal seam 14 at the upper rear of the package 10 and extends substantially upwardly therefrom. Preferably, in the second embodiment, the header 15 is not joined to the front blister 12 by a living hinge, but a living hinge could be included if desired. Such disposition of the header 15 permits the packages 10 to be stacked vertically by inverting one package 10 over the other, so that the headers 15 are oriented along the respective fronts of the vertically adjacent packages 10 during the stacking and shipping thereof (see FIG. 13). In this regard, these headers 15 permit stacking and shipping of the packages 10 while occupying minimal space. This permits the package 10 of the present invention to be placed, for example, in a box, inverted as above (FIG. 13), to reduce shipping and storage space. This further permits the packages 10 to be shipped without having a shipping tray.

The header 15 has an aperture rack stand hole or cut out 17 formed therein for removably receiving a support 2, (as in FIGS. 6A, 6B) such as a display rack, therethrough. In this fashion, the package 10 may be hung from the support for the display thereof (see FIG. 14). Packages of the prior art 30 are shown displayed in alternate horizontal rows to the packages 10 of the present invention wherein the space savings are more easily seen. Also, the display shows batteries of different sizes in the packages.

As with the embodiment illustrated in FIGS. 1–8, the header 15 is formed from a back layer 18 and a front layer 19. The back layer 18 is formed with the rear blister 13 and the front layer 19 is formed with the front blister 12 (FIG. 12). The two (front and back) layers 18 and 19 are joined to one another by appropriate means (such as radio frequency welding etc.).

A slit 20 is formed (die cut) in the back layer 18. Preferably, this slit 20 is located near the base of hole 17. This permits the user to insert a finger into the slit 20 and grasp one of the layers (preferably the back layer 18) of the package. The layers of the package may thereby be separated for gaining access to the batteries 1 carried therein in a manner as shown in FIG. 7.

If desired, a sheet 25 with printing thereon (such as advertising material) may be inserted between the two layers 18 and 19 of the header 15. Alternatively, printing may be directly made on either or both of the layers 18 or 19. In this respect, it is also noted that the clear nature of the housing permits insignia, information, etc., that is printed on the batteries themselves to be viewed by potential purchasers.

Finally, it is further preferred that the front blister 12 have a top portion and a front portion, the top portion of the front blister 12 is substantially adjacent to the header 15, when the blisters 12 and 13 are joined to one another. An enlarged pocket 23 is formed in the top portion of the blister 12. This pocket 23 is sized and positioned to receive and display therein at least a portion of advertising material 25 that is disposed in the package extending from this pocket 23 into the header portion 15 when the front and rear blisters 12 and 13 are joined to one another (see FIGS. 11 and 12). Advertising material 25' may also additionally be disposed in the back of the package 10. The advertising material 25' may extend from the back of the header 15 downwardly into the rear blister 13. Preferably, a single sheet of advertising material 25, is used which is folded at the top of the header 15 and extends downwardly into the front blister 12 and the rear blister 13. Instructions and the name of the product 26 can be printed on the advertising material 25, 25'.

From the foregoing description, it can be seen that the packages 10 of the present invention are designed to be hung from a rack or to be self-standing (free-standing or self-supporting) for placement on a shelf or counter. The design permits multiple alignment, so that one package 10 is immediately adjacent to the next package without wasting space.

It can also be seen that the packages, with their printed header 15 and their clear housing 10 is also a self-display. This greatly enhances their commercial value.

Finally, it is noted that the packages 10 of the present invention can be used with any round battery such as "C", "D", "AA" and "AAA" size cells.

Figure 15A:
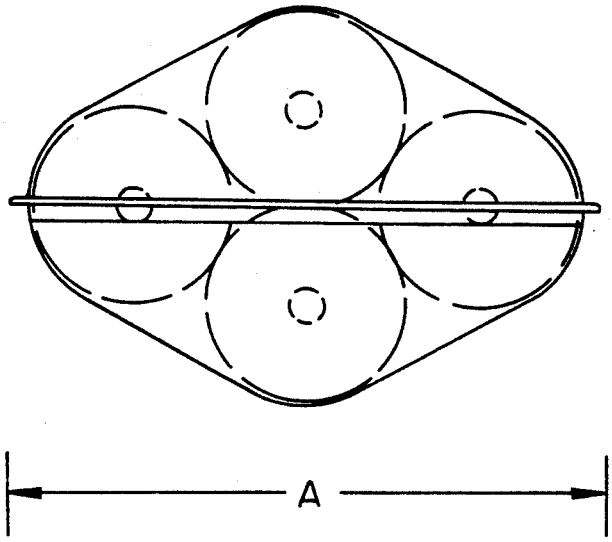
FIG. 15A PRIOR ART
FIG. 15A is a top elevational view of the package of the prior art.
Figure 15B:
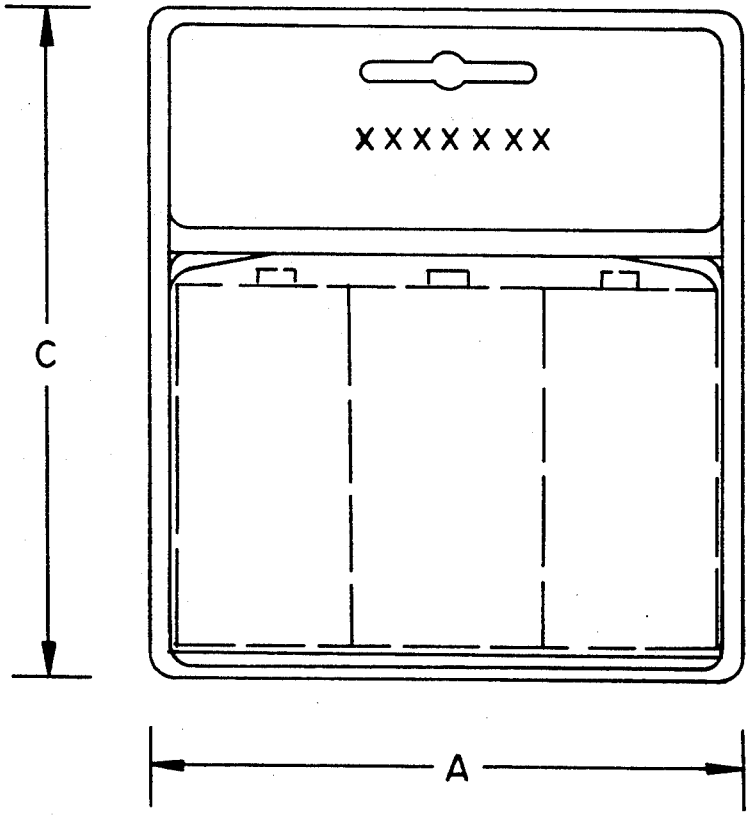
FIG. 15B PRIOR ART
FIG. 15B is a front view of the package of the prior art.
Figure 16A:
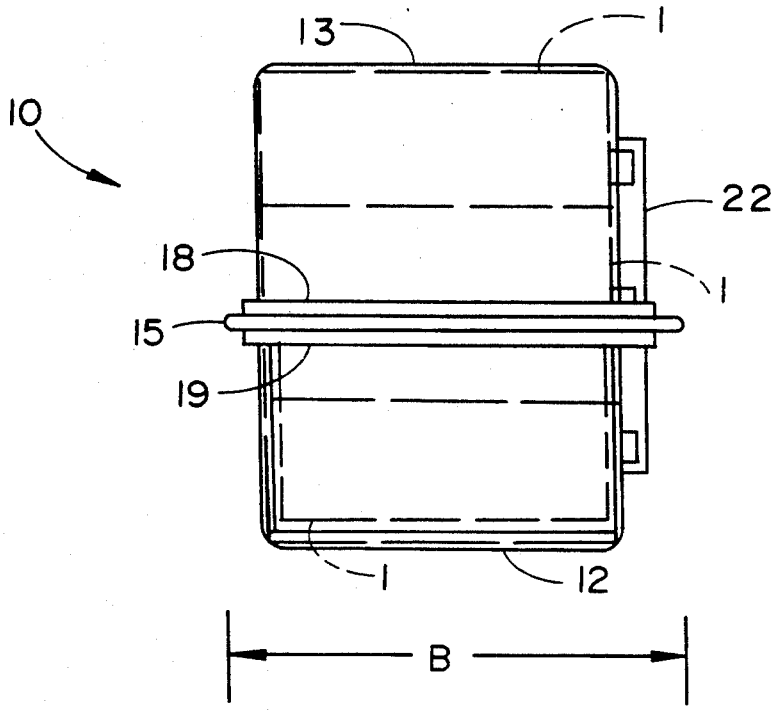
FIG. 16A is a top elevational view of the package of FIG. 9.
Figure 16B:
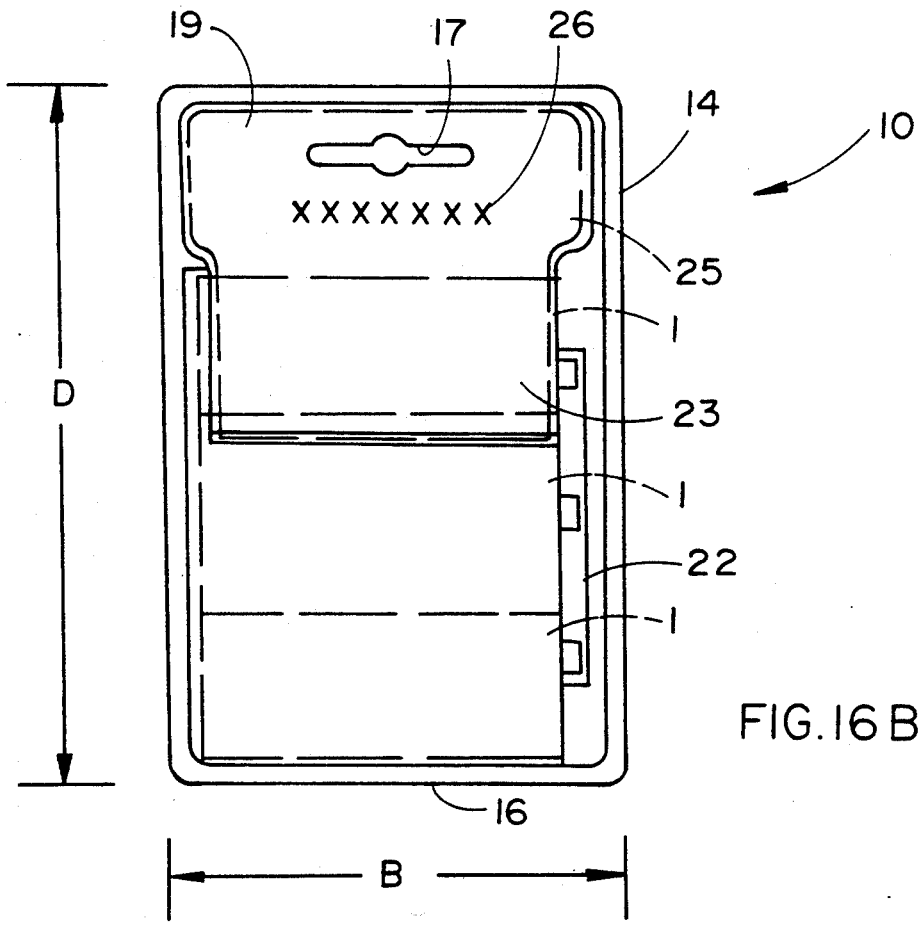
FIG. 16B is a front view of the package of FIG. 9.
Figure 17:
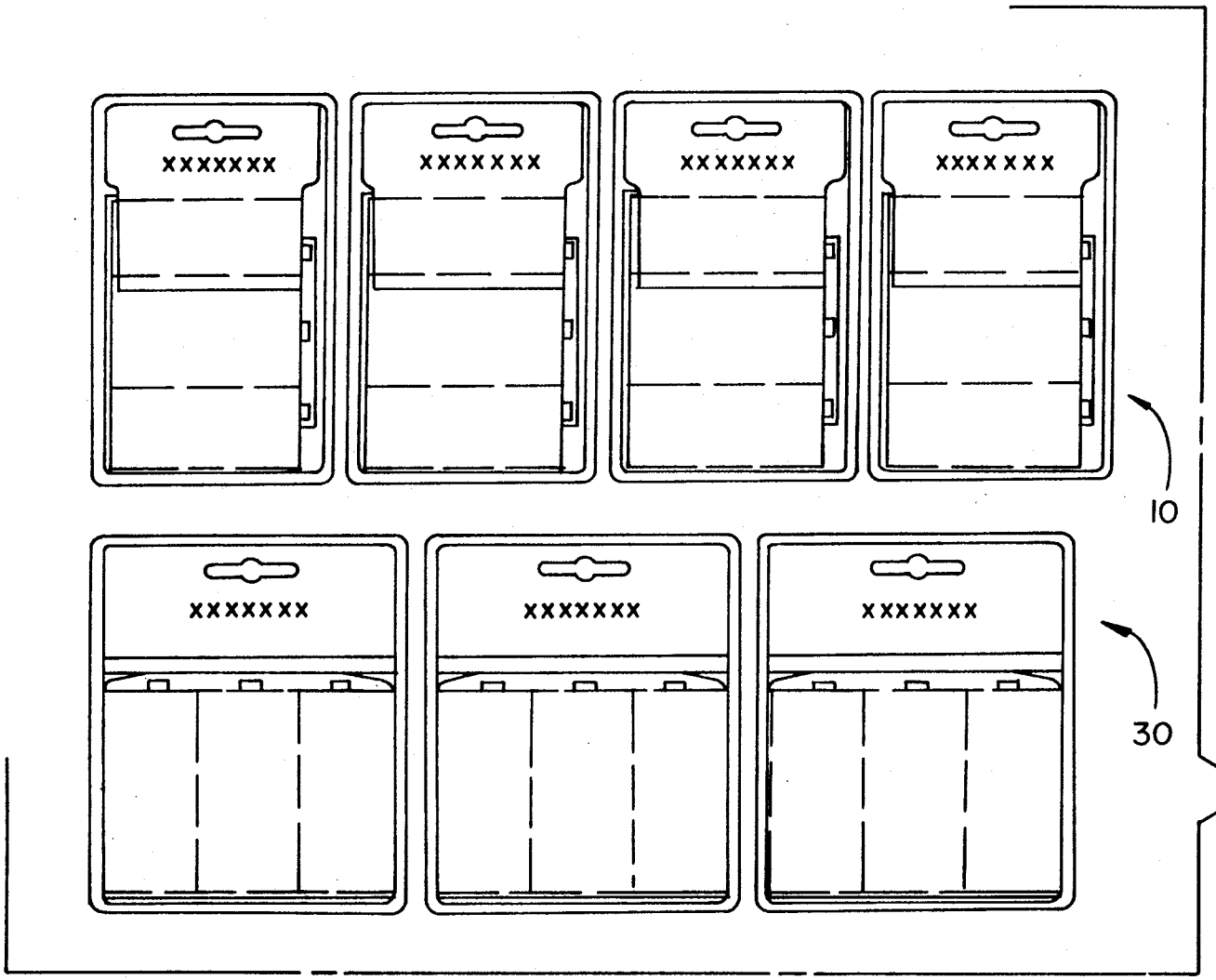
FIG. 17 shows packages of FIG. 9 compared to packages of the prior art.

In the prior art (FIGS. 15A and B), the batteries in the package are disposed so that the batteries are oriented vertically when the package is suspended from a display rack. The batteries are arranged in a staggered manner, having a rhomboid shape when viewed from the top of the package. When so packaged, the width of the package is the longest diagonal A of the rhomboid plus the seams. In the present invention (FIGS. 16A and B), the batteries are disposed so that the batteries are oriented horizontally when the package is suspended from a display rack. The batteries are arranged in a different staggered manner, having a substantially square shape. The width of the package of the present invention is the width B of the square plus the seams. The length of B is approximately ¾ of the length of A. The height D of the package of the present invention (FIG. 16B) is only slightly greater than the height C of the package of the prior art (FIG. 15B) due to the pocket 23 receiving at least a portion of the advertising material 25 disposed in the package of the present invention whereas in the prior art, all of the advertising material is disposed above the batteries.

Compared to the prior art (FIG. 17), the package of the present invention is more space effective; more product can be placed in the same amount of space. For every three (3) packages of the prior art, there can be accommodated four (4) packages of the present invention. This is an approximate 33% increase in product/space ratio. A further savings is that the package of the present invention requires less material. For example, in a package of "D" size batteries, the present invention requires 16% less material and in a package of "C" size batteries, a 37% decrease in material is obtained. Not only is the present invention more cost effective to produce, but there is less material contributing to environmental waste. These savings are further enhanced by elimination of the plastic display tray, reduction in the amount of corrugated board in the overpackage for shipment, and reduction in transportation costs due to less voluminous packaging for a given number of batteries. Corrugated board savings of 43% for D-cells and 57% for C-cells are obtained.

Obviously, many modifications may be made without departing from the basic spirit of the present invention. Accordingly, it will be appreciated by those skilled in the art, that within the scope of the appended claims, the invention may be practiced other than has been specifically described herein.

What is claimed is:

1. A package for the display of batteries comprising a substantially quadrilateral housing formed by a front blister and a rear blister, each blister having a substantially triangular cross-section, each blister having flanges extending outwardly therefrom, the flanges on the front blister being peripherally bonded to the flanges on the rear blister, thereby forming a substantially diagonal seam therebetween for removably joining the front and rear blisters to one another, the housing sized to receive therein at least two lower batteries disposed substantially horizontally therein in a side-by-side arrangement and at least two upper batteries disposed substantially horizontally therein in a side-by-side arrangement on top of the lower batteries, and the diagonal seam extending outwardly from the package forming a header with the front blister and the rear blister of the housing, the header being integrally joined to a portion of the diagonal seam and extending upwardly therefrom, such that the package may be hung being supported by the header and further such that packages may be stacked vertically by inverting one package over the other, so that the headers are oriented along the respective fronts of the vertically adjacent packages.

2. The package of claim 1, wherein when the front and rear blisters are joined to one another, the housing has a substantially rectangular shape.

3. The package of claim 1, wherein the header is an integral extension of the diagonal seam.

4. The package of claim 1, wherein a portion of advertising material is disposed in the header and extends downwardly into the rear blister.

5. A package for the display of batteries comprising a housing formed by a front blister and a rear blister and having a substantially diagonal seam formed therebetween for joining the front and rear blisters to one another, the housing sized to receive therein at least two lower batteries disposed substantially horizontally therein in a side-by-side arrangement and at least two upper batteries disposed substantially horizontally therein in a side-by-side arrangement on top of the lower batteries, and a header formed with the front blister and the rear blister of the housing and extending upwardly therefrom, such that the package may be hung being supported by the header and further such that packages may be stacked vertically by inverting one package over the other, so that the headers are oriented along the respective fronts of the vertically adjacent packages; and wherein the front blister has a top portion, the top portion of the front blister being substantially adjacent to the header when the front and rear blisters are joined to one another, and further wherein the package is further comprised of the top portion of the front blister having a pocket formed therein to receive and display therein at least a portion of advertising material that extends from this pocket into the header portion when the front and rear blisters are joined to one another.

6. The package of claim 5, wherein the advertising material is folded in the header portion and the advertising material extends downwardly into the rear blister.

7. A package for the display of batteries comprising a housing formed by a front blister and a rear blister and having a substantially diagonal seam formed therebetween for joining the front and rear blisters to one another, the housing sized to receive therein at least two lower batteries disposed substantially horizontally therein in a side-by-side arrangement and at least two upper batteries disposed substantially horizontally therein in a side-by-side arrangement on top of the lower batteries, and a header formed with the front blister and the rear blister of the housing and extending upwardly therefrom, such that the package may be hung being supported by the header and further such that packages may be stacked vertically by inverting one package over the other, so that the headers are oriented along the respective fronts of the vertically adjacent packages; and wherein the front and rear blisters have respective opposite side walls and further wherein the package further comprises one of the side walls of the front and rear blisters having respective mating pockets formed therein, such that when the blisters are joined to one another, a single pocket is formed for receiving therein the positive terminals of each battery, whereby proper orientation of all the batteries disposed in the package is assured, so that said batteries are fitted in a minimal space, and further so that the batteries may be easily read and viewed when in the package.

8. The package of claim 7, wherein the pockets are formed in the one of the side walls of the front and rear blisters, so that when the blisters are joined to one another, the single enlarged pocket formed is located approximately half in the front blister and approximately half in the rear blister.

9. The package of claim 1, wherein the front and rear blisters have a horizontal length and the batteries have a vertical length, and wherein the horizontal length of the blisters is slightly longer than the vertical length of the batteries, such that minimal width is provided to the package.

10. The package of claim 1, further comprising the seam including an edge extending substantially downwardly from the blisters, thereby defining a foot for aiding in supporting the package level on a flat surface.

11. The package of claim 1, wherein the header further has an aperture formed therein for receiving a support therethrough, such that the package may be hung from the support for the display thereof.

12. The package of claim 1, wherein the header is formed from a back layer that is formed with the rear blister and from a front layer formed with the front blister, the two layers of the header being joined to one another having a slit formed therebetween, so that a user may insert a finger into the slit and grasp one of the layers of the package for separating the layers and opening the package.

13. The package of claim 1, wherein the housing is substantially rectangular in shape having an upper rear and a lower front, so that the housing is complementary-shaped permitting multiple alignment thereof with other of said packages, whereby the packages are immediately adjacent to the next package without wasting space therebetween.

14. The package of claim 13, further wherein the substantially diagonal seam is formed extending from the upper rear of the package to the lower front of the package.

15. The package of claim 14, wherein the header is formed at the upper rear of the package.

16. A package for the display of batteries comprising a housing formed by a front blister and a rear blister and having a substantially diagonal seam formed therebetween for joining the front and rear blisters to one another, the housing sized to receive therein at least two lower batteries disposed substantially horizontally therein in a side-by-side arrangement and at least two upper batteries disposed substantially horizontally therein in a side-by-side arrangement on top of the lower batteries, and a header integrally formed with the housing and extending upwardly therefrom, such that the package may be hung being supported by the header, and further such that the packages may be stacked vertically by inverting one package over the other, so that the headers are oriented along the respective fronts of the vertically adjacent packages, and wherein the front blister has a top portion, the top portion of the front blister being substantially adjacent to the header when the front and rear blisters are joined to one another, and further wherein the package is further comprised of the top portion of the front blister having a pocket formed therein to receive and display therein at least a portion of advertising material that extends from this pocket into the header portion when the front and rear blisters are joined to one another.

17. A package for the display of batteries comprising a housing formed by a front blister and a rear blister and having a substantially diagonal seam formed therebetween for joining the front and rear blisters to one another, the housing sized to receive therein at least, two lower batteries disposed substantially horizontally therein in a side-by-side arrangement and at least two upper batteries disposed substantially horizontally therein in a side-by-side arrangement on top of the lower batteries, a header integrally formed with the housing and extending upwardly therefrom, such that the package may be hung being supported by the header and further such that packages may be stacked vertically by inverting one package over the other, so that the headers are oriented along the respective fronts of the vertically adjacent packages, and wherein the front and rear blisters have respective opposite side walls and further wherein the package further comprises one of the side walls of the front and rear blisters having respective mating pockets formed therein, such that when the blisters are joined to one another, a single enlarged pocket is formed for receiving therein the positive terminals of each battery, whereby proper orientation of all the batteries disposed in the package is assured, so that said batteries are fitted in a minimal space, and further so that the batteries may be easily read and viewed when in the package.

18. A package for the display of batteries comprising a housing formed by a front blister and a rear blister and having a substantially diagonal seam formed therebetween for joining the front and rear blisters to one another, the housing sized to receive therein at least two lower batteries disposed substantially horizontally therein in a side-by-side arrangement and at least two upper batteries disposed substantially horizontally therein in a side-by-side arrangement on top of the lower batteries, a header integrally formed with the housing and extending upwardly therefrom, such that the package may be hung being supported by the header and further such that packages may be stacked vertically by inverting one package over the other, so that the headers are oriented along the respective fronts of the vertically adjacent packages, wherein the header is formed from a back layer that is joined to the rear blister and from a front layer joined to the front blister, the two layers of the header being joined to one another having a slit formed therebetween, so that a user may insert a finger into the slit and grasp one of the layers of the package separating the layers and opening the package; and wherein the front blister has a top portion, the top portion being substantially adjacent to the header when the front and rear blisters are joined to one another, the top portion of the front blister having a pocket formed therein to receive and display at least a portion of advertising material that extends from this pocket into the header between the front and back layers thereof when the front and rear blisters are joined to one another.

19. A package for the display of batteries comprising a housing formed by a front blister and a rear blister and having a substantially diagonal seam formed therebetween for joining the front and rear blisters to one another, the housing sized to receive therein at least two lower batteries disposed be stacked vertically by inverting one package over the other, so that the headers are oriented along the respective fronts of the vertically adjacent packages; wherein the front blister has a top portion, the top portion of the front blister being substantially adjacent to the header when the front and rear blisters are joined to one another, and further wherein the package is further comprised of the top portion of the front blister having a pocket formed therein to receive and display therein at least a portion of advertising material that extends from this pocket into the header portion when the front and rear blisters are joined to one another; and wherein the front and rear blisters have respective opposite side walls and further wherein the package further comprises one of the side walls of the front and rear blisters having respective mating pockets formed therein, such that when the blisters are joined to one another, a single enlarged pocket is formed for receiving therein the positive terminals of each battery, whereby proper orientation of all the batteries disposed in the package is assured, so that said batteries are fitted in a minimal space, and further so that the batteries may be easily read and viewed when in the package.

* * * * *